United States Patent [19]

Oliff

[11] 4,341,309

[45] Jul. 27, 1982

[54] WRAP-AROUND CARRIER

[75] Inventor: James R. Oliff, Austell, Ga.

[73] Assignee: The Mead Corporation, Dayton, Ohio

[21] Appl. No.: 194,643

[22] Filed: Oct. 6, 1980

[51] Int. Cl.[3] ..... B65D 65/00

[52] U.S. Cl. ..... 206/429; 206/435; 229/52 BC

[58] Field of Search ..... 229/52 BC, 52 B, 52 R; 206/435, 429, 427

[56] References Cited

U.S. PATENT DOCUMENTS

| | | | |
|---|---|---|---|
| 1,983,010 | 12/1934 | Spees | 206/427 |
| 2,755,963 | 7/1956 | Ringler | 229/28 BC |
| 2,901,159 | 8/1959 | Talbot, Jr. | 206/427 |
| 3,593,849 | 7/1971 | Helms | 206/427 |
| 3,688,972 | 9/1972 | Mahon | 206/427 |
| 4,034,852 | 7/1977 | Forrer | 206/427 |
| 4,205,748 | 6/1980 | Wilson | 229/53 BC |
| 4,243,138 | 1/1981 | Wilson | 229/52 BC |
| 4,284,195 | 8/1981 | Champlin | 206/427 |

FOREIGN PATENT DOCUMENTS

| | | | |
|---|---|---|---|
| 24782 | 3/1980 | European Pat. Off. | 206/429 |

*Primary Examiner*—Joseph Man-Fu Moy
*Attorney, Agent, or Firm*—Erwin Doerr

[57] ABSTRACT

A wrap-around carrier formed from a unitary paperboard blank and particularly adapted for accommodating large bottles, the carrier comprising a bottom wall and side walls extending upwardly therefrom and inclined toward each other to conform generally to the upwardly tapered configuration of the bottles, the side walls being joined by a narrow panel overlying the tops of said bottles and provided with handgripping apertures adjacent the top panel. Handle reinforcing panels are hinged to the carrier side walls and are folded inwardly into overlapping relationship therewith to provide a double play thickness of material in the vicinity of the hand-gripping apertures.

9 Claims, 3 Drawing Figures

WRAP-AROUND CARRIER

This invention relates to a bottle carrier of the wrap-around type and particularly, though not exclusively, to that class of wrap-around carrier adapted for accommodating a pair of large bottles, for example, of 2 liter capacity. The carrier is formed with hand-gripping apertures in its side walls which are reinforced so as to better withstand the load transmitted to the gripping apertures when the carrier is carried.

One aspect of the present invention provides a wrap-around carrier for accommodating a plurality of bottles arranged in a single row, which carrier is formed from a unitary blank of foldable sheet material and comprises a bottom wall, opposing side walls extending upwardly from the bottom panel and inclined toward each other to conform generally to the upwardly tapered configuration of the bottles, and a top panel joined to the upper edges of the side walls, characterized by a reinforced hand-gripping aperture formed in at least one of the side walls of the carrier, said reinforcement being provided by at least one handle reinforcing panel hinged to and folded inwardly into overlapping relationship with the respective side wall of the carrier to provide extra material around said hand-gripping aperture.

Another aspect of the invention provides an elongate blank for forming a wrap-around carrier of the type suitable for accommodating a linear series of bottles, which blank comprises a top wall panel, a pair of side wall panels hinged respectively to opposed transverse edges of said top wall panel, and a pair of bottom wall panels hinged respectively to said side wall panels, characterized in that each of said side wall panels is formed with a hand-gripping aperture and a handle reinforcing panel hinged to the side wall panel along a fold line extending obliquely with respect to the longitudinal and transverse axes of the blank, each of said handle reinforcing panels being formed with an aperture for registration with a respective hand-gripping aperture when the reinforcing panel is folded into overlapping relationship with its associated side wall panel.

For a better understanding of the invention, reference is made to the following detailed description taken in conjunction with the accompanying drawings in which.

Figure 1:
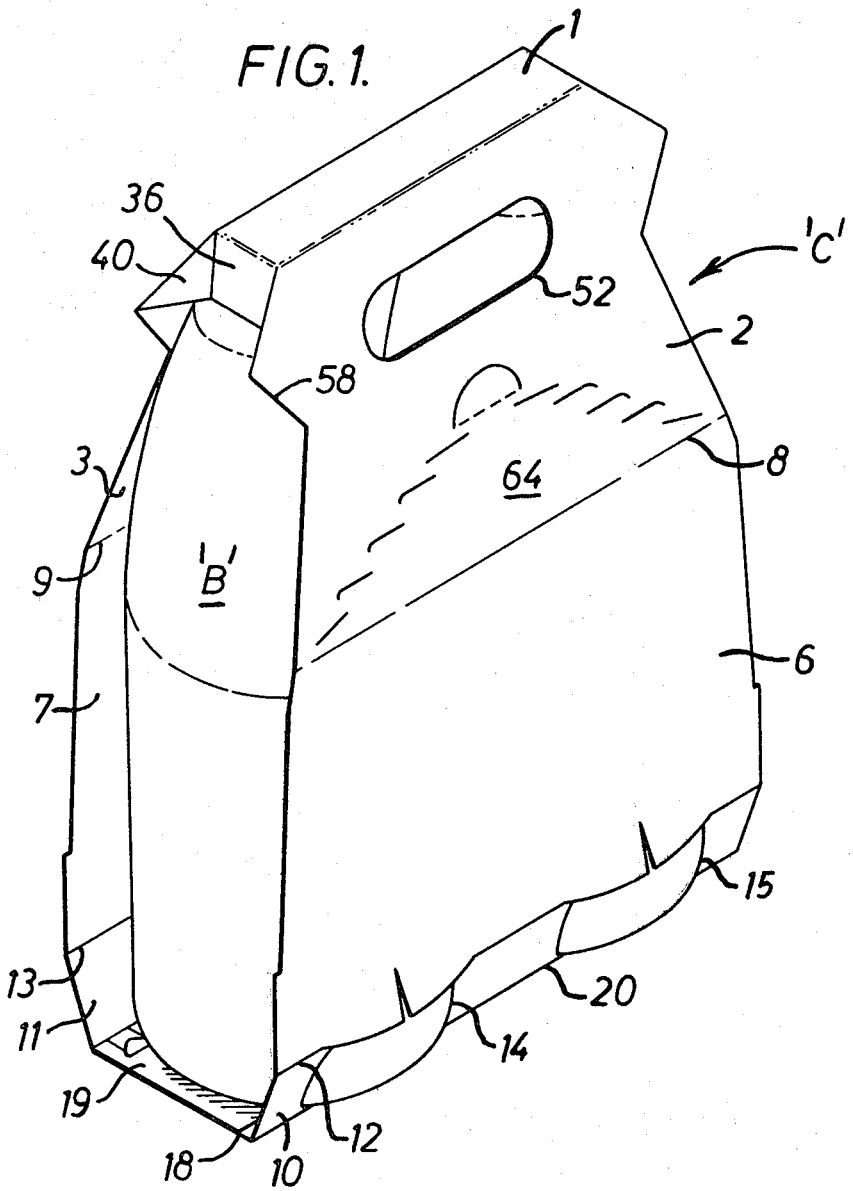
FIG. 1 is a perspective view of the wrap-around carrier suitable fr accommodating a pair of large bottles and to which this invention is applicable.

Referring to the drawings, the numeral 1 generally designates the central top panel of the carrier 'C' which is narrow relative to the other carrier panels. A pair of side walls are hinged to opposed transverse edges of the top panel, the side walls comprising a pair of upper sloping panels 2 and 3 hinged along fold lines 4 and 5, respectively, to the transverse side edges of top panel 1 and a pair of main side wall panels 6 and 7 hinged to the top sloping panels 2 and 3 along transverse fold lines 8 and 9, respectively. Similarly, bottom sloping panels 10 and 11 are hinged to the bottom edges of the main side wall panels 6 and 7 along transverse fold lines 12 and 13, respectively. Formed in bottom sloping panel 10 are bottle heel receiving openings 14 and 15. As is well known in the art, the bottom heel portions of the bottles protrude through the openings 14 and 15 which respectively serve to hold the bottles 'B' in place within the carrier. In a similar manner, slits 16 and 17 are formed in the bottom sloping panel 11 and have a corresponding function to that of the openings 14 and 15 in bottom sloping panel 10.

For forming the bottom of the carrier, a pair of bottom panels 18 and 19 are hinged respectively to the bottom sloping panels 10 and 11 along transverse fold lines 20 and 21.

In order to tighten the wrapper about the pair of bottles 'B' during the packaging operation, a pair of tightening apertures 22, 23 are struck from the bottom panel 19 and two pairs of similar tightening apertures 24, 25 and 26, 27 are formed in the bottom panel 18. As is understood in the art, suitable machine elements enter the tightening apertures 24, 25 and move underneath the pair of bottles towards the bottom panel 19. Similar machine elements enter the tightening apertures 22, 23 and draw the bottom panel 19 towards the bottom panel 18.

The wrapper is suitably tightened when the apertures 22, 23 and 26, 27, respectively, are brought into register and generally simultaneously apertures 24, 25 are brought into register with the respective scalloped areas 28, 29 formed in the free end edge of bottom panel 19. After the wrapper has thus been tightened, locking tabs 30 to 32, formed in the bottom panel 18, are driven through cooperating locking openings defined by the retaining tabs 33 to 35 formed in the other bottom panel 19. Of course, the panels 18 and 19 are then disposed in overlapping relationship with panel 18 being on the outside.

In order to minimize endwise movement of the bottles within the carrier, a pair of downwardly inclined bottle retaining flaps 36 and 37 are hinged to opposed ends of the top panel 1 along longitudinal fold lines 38 and 39 respectively. The retaining flaps 36, 37 are further joined to the top sloping panels 2, 3 by means of gusset panels 40 to 43 along oblique fold lines 44 to 51, respectively, which serve to maintain the flaps in their downwardly inclined positions.

In order to lift and carry the carrier 'C', a pair of hand-gripping apertures 52 and 53 are formed in each of the upper sloping panels 2, 3, respectively. Hand-gripping aperture 52 in formed with a hand-cushioning flap 54 and, similarly the hand-gripping aperture 53 is provided with hand-cushioning flap 55.

Figure 2:
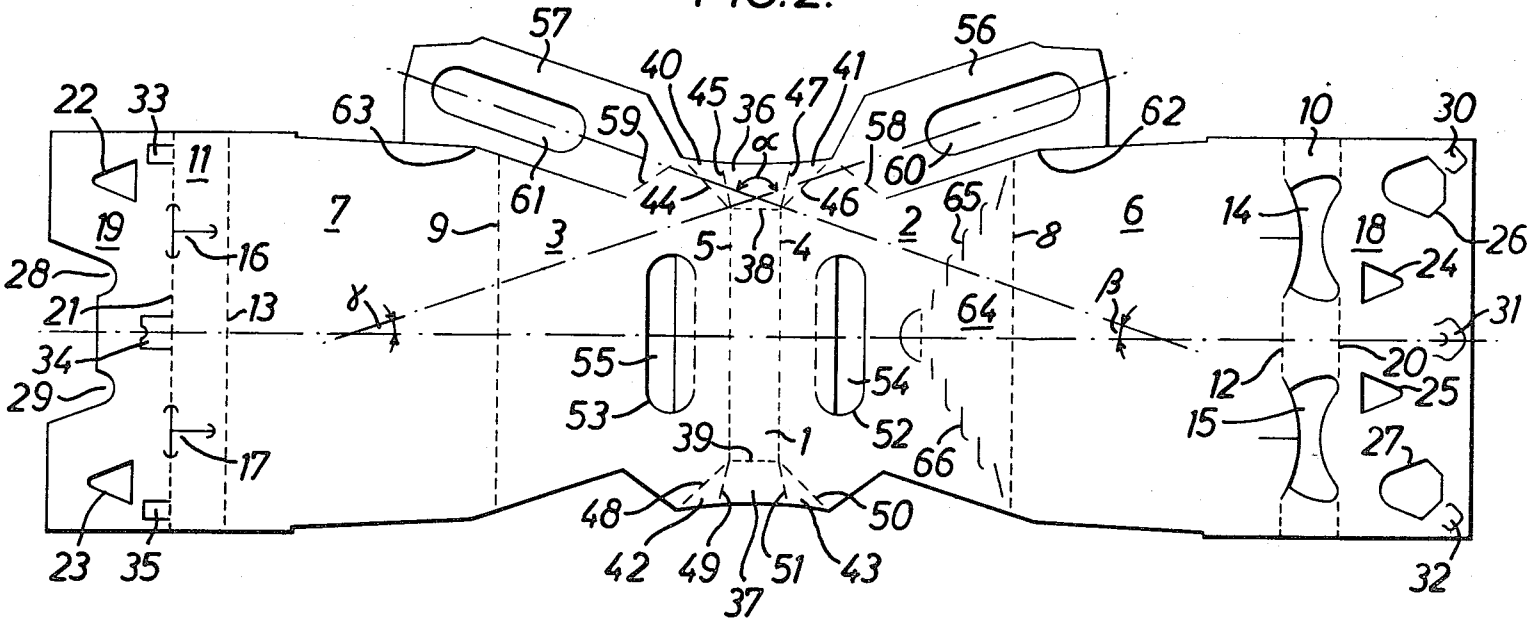
FIG. 2 is a plan view of a blank from which the carrier shown in FIG. 1 is formed.

In order to strengthen the handle area of the carrier, a pair of handle reinforcing panels 56, 57 are hinged to the upper sloping panels 2, 3 along oblique fold lines 58, 59, respectively, which fold lines extend entirely within the confines of the side walls 6 and 7. The handle reinforcing panel 56 is formed with a central elongate aperture 60 and similarly the handle reinforcing panel 57 is provided with a central elongate aperture 61. As will be best seen from FIG. 2, each of the handle reinforcing panels 56 and 57 is struck at least in part from a side wall of the carrier and, more particularly, partly from the respective upper sloping panel 2, 3 and partly from the respective main side wall panel 6, 7 along side edges 62, 63, respectively. Moreover, the handle reinforcing panels 56 and 57 are each constructed and arranged so as to lie obliquely with respect to the central longitudinal axis of the blank. Hence, an extension of the longitudinal axis of each of the panels 56 and 57 intersect one another so as to form an obtuse angle $\alpha$ and intersect the central longitudinal axis of the blank to form acute angle $\beta$ and γ. Desirably, the point of mutual intersection of the extended axes lies within the area defined by the adjacent bottle retaining flap 36 when the blank is in its unfolded condition. At any rate, however, it is preferred to have the hand-gripping apertures 52, 53 and hand hole reinforcing panels 56, 57 arranged and dimensioned so that the retaining flap 36 will be accommodated between the two hand hole reinforcing panels 56, 57 as it is shown in FIG. 2.

Figure 3:
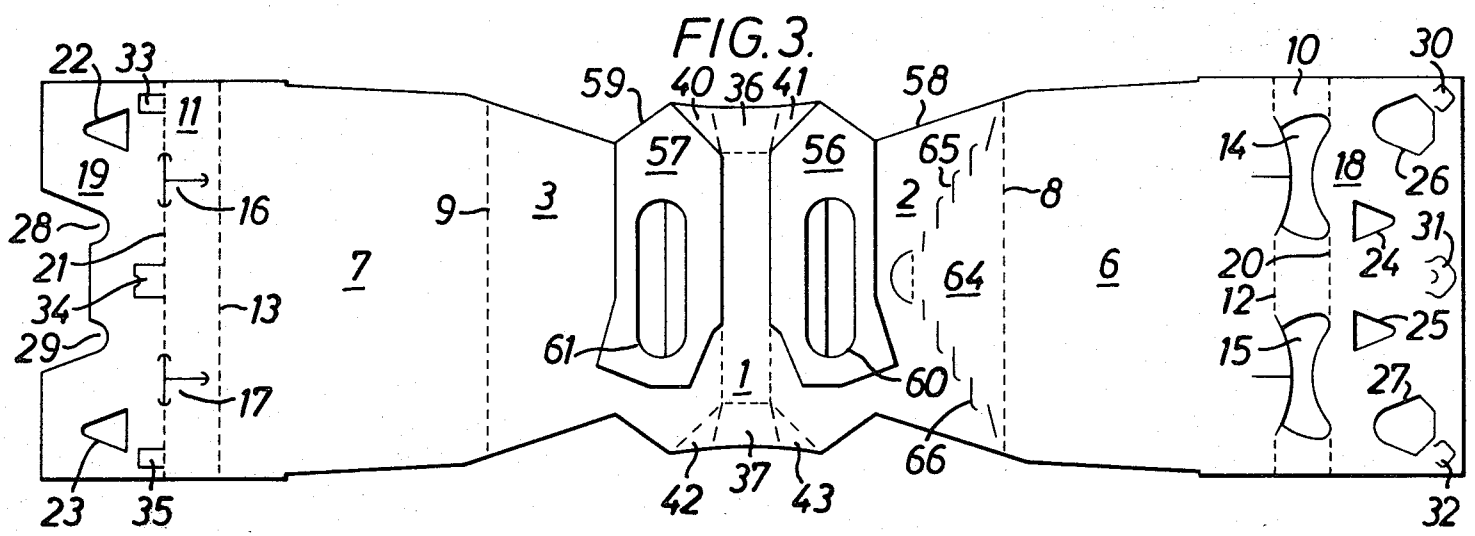
FIG. 3 is a plan view of the blank with the supplementary reinforcing handle panels folded into their final positions.

As best seen in FIG. 3, each of the handle reinforcing panels 56, 57 is folded about the fold lines 58 and 59, respectively, into overlapping relationship with the interior surface of the upper sloping panels 2, 3, respectively, and preferably are glued thereto. It will be noted that the fold lines 58 and 59 are arranged so that the elongate apertures 60 and 61 are brought into register with the apertures 52 and 53, respectively, whereby the longitudinal axes of the reinforcing panels extend perpendicularly with respect to the central longitudinal axis of the blank. Thus, a double ply thickness of material is provided in the region of the hand-gripping apertures of the carrier.

In order to provide for easy access to the bottles 'B', a tear-away panel 64 is formed in the upper sloping panel 2 and provided by two series of perforations 65, 66, respectively.

The wrap-around carrier according to the invention thus provides a package which has increased strength in the vicinity of the handle means, a feature which is extremely desirable in packages accommodating large capacity bottles. Moreover the reinforcement is provided by supplementary panels arranged in such a manner as to afford considerable savings in materials.

The embodiments of the invention in which exclusive property or privilege is claimed are defined as follows:

1. A wrap-around carrier for accommodating a plurality of bottles arranged in a single row, which carrier is formed from a unitary blank of foldable material and comprises a bottom wall, opposing side walls extending upwardly from said bottom wall and inclined toward each other to generally conform to the upwardly tapered configuration of the bottles, a top panel joined to the upper edges of said side walls and overlying the tops of the bottles, a reinforced hand-gripping aperture formed in at least one of said side walls below said top panel, said hand-gripping aperture being reinforced by at least one handle reinforcing panel hinged to said one side wall and folded inwardly into overlapping relationship therewith to provide extra material around said hand-gripping aperture, characterized in that said handle reinforcing panel is hinged to its respective side wall along a fold line extending obliquely with respect to the longitudinal and transverse axes of the blank from which said carrier is formed.

2. The wrap-around carrier according to claim 1, characterized in that a reinforced hand-gripping aperture is provided in each of said side walls and the reinforcement is provided by a handle reinforcing panel associated with each of said side walls and hinged thereto along the same end edge, each handle reinforcing panel including an aperture arranged in register with the hand-gripping aperture in the respective side wall, registration being effected by folding said reinforcing panels into overlapping relationship with said respective side wall.

3. The wrap-around carrier according to claim 2, characterized in that each of said handle reinforcing panels is formed at least partially from material taken from the upper portions of said respective side walls.

4. The wrap-around carrier according to claim 3, further including retaining flaps joined to opposing ends of said top panel and adjacent ends of said side walls and extending downwardly at a substantial angle to said top panel.

5. A blank for a wrap-around carrier of the type suitable for accommodating a plurality of bottles arranged in a single row, which blank comprises a top panel, a pair of side wall panels hinged to opposing transverse edges of said top panel, a pair of bottom wall panels hinged to said side wall panels along fold lines remote from said top panel, and a hand-gripping aperture formed in each of said side wall panels adjacent said top wall panel, characterized in that at least one handle reinforcing panel is provided which is hinged to one of said side wall panels along a fold line extending obliquely with respect to the longitudinal and transverse axes of said blank, said reinforcing panel being formed with an aperture for registration with at least one of said hand-gripping apertures when folded into overlapping relationship with its associated side wall panel.

6. The blank according to claim 5 comprising a pair of handle reinforcing panels foldably joined at one longitudinal end of said blank to upper portions of said side wall panels along outwardly converging fold lines.

7. The blank according to claim 6, further comprising a retaining flap foldably joined to at least one end of said top panel and disposed between said pair of handle reinforcing panels.

8. The blank according to claim 5 wherein said handle reinforcing panel is formed at least partially from material taken from said associated side wall panel.

9. The blank according to claim 8 wherein said oblique fold line associated with said reinforcing panel extends within the confines of said side wall panel.

* * * * *